US010025241B2

(12) United States Patent
Soeda

(10) Patent No.: US 10,025,241 B2
(45) Date of Patent: Jul. 17, 2018

(54) FIXATION DEVICE AND IMAGE FORMATION APPARATUS

(71) Applicant: Oki Data Corporation, Tokyo (JP)

(72) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/410,340

(22) Filed: Jan. 19, 2017

(65) Prior Publication Data

US 2017/0242377 A1 Aug. 24, 2017

(30) Foreign Application Priority Data

Feb. 22, 2016 (JP) ..... 2016-030761

(51) Int. Cl.
*G03G 15/20* (2006.01)

(52) U.S. Cl.
CPC ..... *G03G 15/2053* (2013.01)

(58) Field of Classification Search
CPC ..... G03G 15/2035; G03G 15/2085
See application file for complete search history.

(56) References Cited

U.S. PATENT DOCUMENTS

2009/0067901 A1* 3/2009 Lee ..... G03G 15/2053 399/329
2012/0243922 A1* 9/2012 Uehara ..... G03G 15/2053 399/329
2013/0084111 A1* 4/2013 Iwata ..... G03G 15/2053 399/329

FOREIGN PATENT DOCUMENTS

JP 2001-194937 A 7/2001

* cited by examiner

*Primary Examiner* — Victor Verbitsky
(74) *Attorney, Agent, or Firm* — Metrolexis Law Group, PLLC

(57) ABSTRACT

A fixation device includes: an endless fixation belt an outer surface of which comes into contact with a printing medium at a fixation position; a contact member which includes a contact surface in contact with an inner surface of the fixation belt at the fixation position, the contact surface being displaceable, in a region corresponding to an end portion in the width direction of the printing medium; and a support member which includes a support surface supporting the contact member. A second distance from a reference passage surface of the printing medium to a widthwise end position on the support surface is larger than a first distance from the reference passage surface of the printing medium to a widthwise center position on the support surface.

18 Claims, 10 Drawing Sheets

FIXATION DEVICE AND IMAGE FORMATION APPARATUS

CROSS REFERENCE TO RELATED APPLICATIONS

This application claims priority based on 35 USC § 119 from prior Japanese Patent Application No. 2016-030761 filed on Feb. 22, 2016, entitled "FIXATION DEVICE AND IMAGE FORMATION APPARATUS", the entire contents of which are incorporated herein by reference.

BACKGROUND OF THE INVENTION

1. Field of the Invention

The present disclosure relates to a fixation device and an image formation apparatus including the same.

2. Description of Related Art

A fixation device is conventionally used to fix the developer on a printing medium in an image formation apparatus. A fixation device includes, for example, a heater, an endless fixation belt, and a heat transfer member which is in contact with an inner surface of the fixation belt and transfers heat of the heater to the fixation belt.

Japanese Patent Application Publication No. 2001-194937 discloses a fixation device including an endless film as a fixation belt, a heater board, and a film guide including a planar heater attachment surface and a fixation nip surface. The fixation nip surface of this fixation device is formed in a crown shape (an arc shape) in a film width direction in order to prevent the occurrence of wrinkles in a thin printing medium and to reduce the stress exerted to the heater board by a thick printing medium.

SUMMARY OF THE INVENTION

In the fixation device described in Japanese Patent Application Publication No. 2001-194937 (Patent Document 1), however, there is a large pressure difference between each of the regions on the fixation belt corresponding to respective end portions in the width direction of the printing medium and a region on the fixation belt corresponding to a central portion in the width direction of the printing medium when, for example, the developer on a thick printing medium is to be fused. Such a pressure difference may then cause a deformation of the fixation belt, such as wrinkles or flaws in the surface layer of the fixation belt. In addition, the above-described pressure difference may also occur in regions on the fixation belt corresponding to the respective end portions in the width direction of a roller in contact with an outer surface of the fixation belt. Note that the above-mentioned problem arises in a conventional fixation device of a different type, as well as in a fixation device including an arc-shaped fixation nip surface such as the fixation device described in Patent Document 1.

An embodiment of the present disclosure aim to provide a fixation device that makes it unlikely that the widthwise end portions of the fixation belt deform.

A first aspect of the invention is a fixation device that includes: an endless fixation belt which is runnably supported and includes an inner surface and an outer surface which comes into contact with a printing medium at a fixation position; a contact member which includes a contact surface in contact with the inner surface of the fixation belt at the fixation position, the contact surface being displaceable in a region corresponding to an end portion in a width direction of the printing medium, the width direction being orthogonal to a conveyance direction of the printing medium; and a support member which includes a support surface supporting the contact member. The support surface of the support member has a shape such that a second distance from a reference passage surface of the printing medium to a position on the support surface corresponding to the end portion in the width direction of the printing medium is larger than a first distance from the reference passage surface of the printing medium to a position on the support surface corresponding to a central portion in the width direction of the printing medium.

A second aspect of the invention is a fixation device that includes: an endless fixation belt which is runnably supported and includes an inner surface and an outer surface which comes into contact with a printing medium at a fixation position; a contact member which includes a contact surface in contact with the inner surface of the fixation belt at the fixation position, the contact surface being displaceable in regions corresponding to widthwise end portions of the printing medium being end portions in a width direction of the printing medium, the width direction being orthogonal to a conveyance direction of the printing medium; and a support member which includes a support surface supporting a first region of the contact member, the first region being inside, in the width direction, of widthwise end portions of the contact member. The support member includes displacement restricting surfaces in regions corresponding to second regions of the contact member, the second regions being outside, in the width direction, of the first region of the contact member, and the displacement restricting surfaces restrict a displacement of the contact member in a direction away from the inner surface of the fixation belt by a contact with the widthwise end portions of the contact member.

According to the aspects of the invention, the widthwise end portions of the fixation belt is unlikely to be deformed.

DETAILED DESCRIPTION OF EMBODIMENTS

Figure 1:
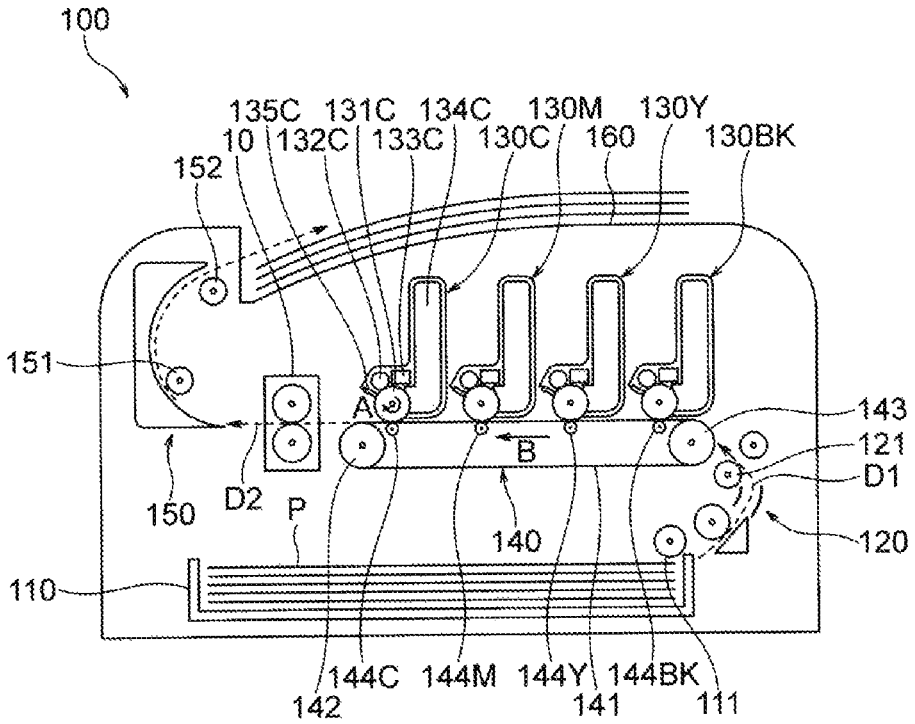
FIG. 1 is a vertical cross-sectional diagram schematically illustrating an example configuration of an image formation apparatus including a fixation device according to Embodiment 1 of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Some of the figures illustrate coordinate axes of XYZ orthogonal coordinate systems. An X-axis is a coordinate axis in a width direction of a fixation belt provided to each of the fixation devices according to the embodiments. A Y-axis is a coordinate axis in a direction (a conveyance direction) in which the fixation device conveys a printing medium at a fixation position. A Z-axis is a coordinate axis in a height direction of the fixation device.

Embodiment 1

FIG. 1 is a vertical cross-sectional diagram schematically illustrating an example configuration of an image formation apparatus including a fixation device according to Embodiment 1. Image formation apparatus 100 illustrated in FIG. 1 includes fixation device 10 according to Embodiment 1, and its examples include a color printer which employs electrophotography and forms a color image. Note that fixation device 10 according to Embodiment 1 can be provided to a single-color printer which forms a single-color image, such as a monochrome printer. Also, fixation device 10 can be provided to other image formation apparatuses such as a copier, a facsimile device, and a multifunction printer (MFP). Note that the dotted arrows in FIG. 1 indicate conveyance directions of printing medium (recording medium) P to be conveyed.

As main components, image formation apparatus 100 includes: feed cassette 110 which retains (stores) printing medium P being a sheet-shaped medium such as a paper sheet; conveyer 120 which conveys printing medium P from feed cassette 110 to the downstream side (in a conveyance direction D1); image formation units 130BK, 130Y, 130M, and 130C which form images of the respective colors (developer images) based on image information; transfer device 140 for transferring the developer images (toner images) onto printing medium P conveyed by conveyer 120; fixation device 10 which fuses the developer images transferred onto printing medium P; and medium discharger 150 which discharges printing medium P having passed through fixation device 10 to the outside of image formation apparatus 100, as illustrated in FIG. 1. Note that although FIG. 1 illustrates four image formation units 130BK, 130Y, 130M, and 130C arranged in the conveyance direction of printing medium P, the number of image formation units included in image formation apparatus 100 may be less than or greater than four.

In order to supply printing media stored (loaded) in feed cassette 110 to a transfer region where the developer images are transferred by transfer device 140, image formation apparatus 100 has a mechanism that picks up one by one printing media P to be conveyed from the loaded printing media, and conveying the picked-up printing media to conveyer 120. Conveyer 120 includes registration rollers 121 which supply printing media P conveyed from feed cassette 110 to the transfer region of transfer device 140 in synchronization with the timing of development by image formation units 130BK, 130Y, 130M, and 130C.

Image formation units 130BK, 130Y, 130M, and 130C respectively form black, yellow, magenta, and cyan developer images. Image formation units 130BK, 130Y, 130M, and 130C have the same structure except for the developer colors. Hereinafter, a configuration of image formation unit 130C is described as a representative example. As illustrated in FIG. 1, image formation unit 130C includes photosensitive drum 131C as an electrostatic latent image carrier which is rotatably supported around a central axis of rotation. In addition, image formation unit 130C includes: charge device (charger) 132C such as a charge roller; exposure device (exposure unit) 133C such as a light-emitting element printhead having a light-emitting element (for example, light-emitting diode (LED)); developer supply device 134C serving as a development unit which supplies toner as the developer to photosensitive drum 131C; and cleaning device 135C including a cleaning blade which scrapes off matter remaining on the surface of photosensitive drum 131C. All of these components are arranged in the order mentioned above in a rotational direction A of photosensitive drum 131C. Charge device 132C uniformly charges the surface of photosensitive drum 131C. Exposure device 133C emits light in accordance with the image information, and exposes the surface of photosensitive drum 131C to light, thereby forming an electrostatic latent image. Developer supply device 134C supplies the developer to the surface of photosensitive drum 131C. After the developer is supplied, a developer image corresponding to the electrostatic latent image is formed on the surface of photosensitive drum 131C. Incidentally, the electrostatic latent image carrier may be a belt-shaped photosensitive belt, not a drum-shaped photosensitive drum.

Transfer device 140 includes: endless conveyance belt (transfer belt) 141 which conveys printing medium P in a conveyance direction B; a pair of tension rollers 142 and 143 which stretch conveyance belt 141; and transfer rollers 144BK, 144Y, 144M and 144C which are arranged opposite to respective image formation units 130BK, 130Y, 130M, and 130C, and transfer developer images onto printing medium P being conveyed in conveyance direction B. At least one of tension rollers 142 and 143 is a drive roller which moves (drives) conveyance belt 141. Transfer rollers 144BK, 144Y, 144M and 144C transfer in sequence the developer images formed by image formation units 130BK, 130Y, 130M, and 130C onto an upper surface of printing medium P. Thus, a color image is formed on printing medium P by superimposing developer images with different colors.

Fixation device 10 fuses the developer images transferred onto printing medium P on printing medium P. Details of fixation device 10 are described later. Medium discharger 150 includes, for example, medium conveyance rollers 151 and 152 as a conveyance mechanism to convey printing medium P, on which the developer images are fused, to an outlet. Outside of this outlet, image formation apparatus 100 includes discharged-paper loader 160 which loads printing medium P thereon after printing.

For example, image formation apparatus 100 having the configuration as described above operates as follows. First, on receipt of a printing instruction from an upper level device (not illustrated) such as a personal computer (PC), image formation apparatus 100 conveys printing medium P from feed cassette 110 to registration rollers 121 utilizing the rotation of pickup roller 111, and conveys printing medium P to transfer device 140 through registration rollers 121. Here in image formation unit 130C, for example, the surface of photosensitive drum 131C is charged by charge device 132C while photosensitive drum 131C is rotating in rotational direction A. Meanwhile, in image formation unit 130C, exposure device 133C exposes the surface of photosensitive drum 131C to light in accordance with image information contained in the printing instruction described above, thereby forming an electrostatic latent image corresponding to the image information. This electrostatic latent image is developed by the developer supplied from developer supply device 134C, and as a result, a developer image is formed on photosensitive drum 131C. The developer image formed on photosensitive drum 131C is transferred onto printing medium P on transfer device 140 being conveyed in conveyance direction B. After the transfer, the developer remaining on photosensitive drum 131C is scraped off by cleaning device 135C to clean photosensitive drum 131C. Thereafter, photosensitive drum 131C is supplied for the next charging. Development in image formation units 130BK, 130Y, and 130M is also performed in the same steps as in image formation unit 130C.

Black, yellow, magenta, and cyan developer images are transferred in sequence while printing medium P is being conveyed in conveyance direction B by transfer device 140. After all developer images necessary for the formation of the image indicated by the image information described above are transferred, printing medium P is conveyed to fixation device 10 from transfer device 140. The operation of fixation device 10 is described later. After passing through the nip region of fixation device 10, printing medium P is conveyed to discharged-paper loader 160 by medium conveyance roller 151.

Figure 2:
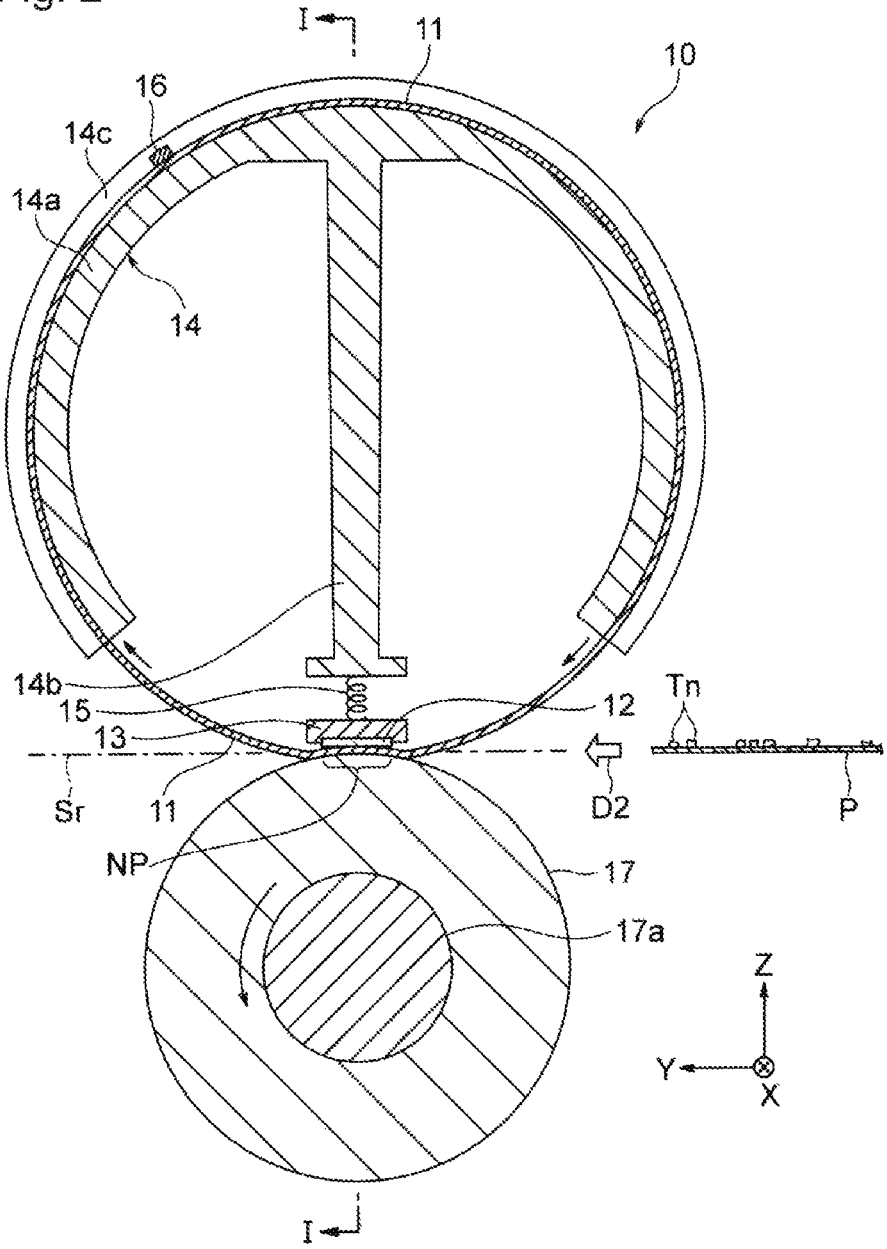
FIG. 2 is a vertical cross-sectional diagram schematically illustrating a main part of the example configuration of the fixation device according to Embodiment 1.
Figures 3A, 3B:
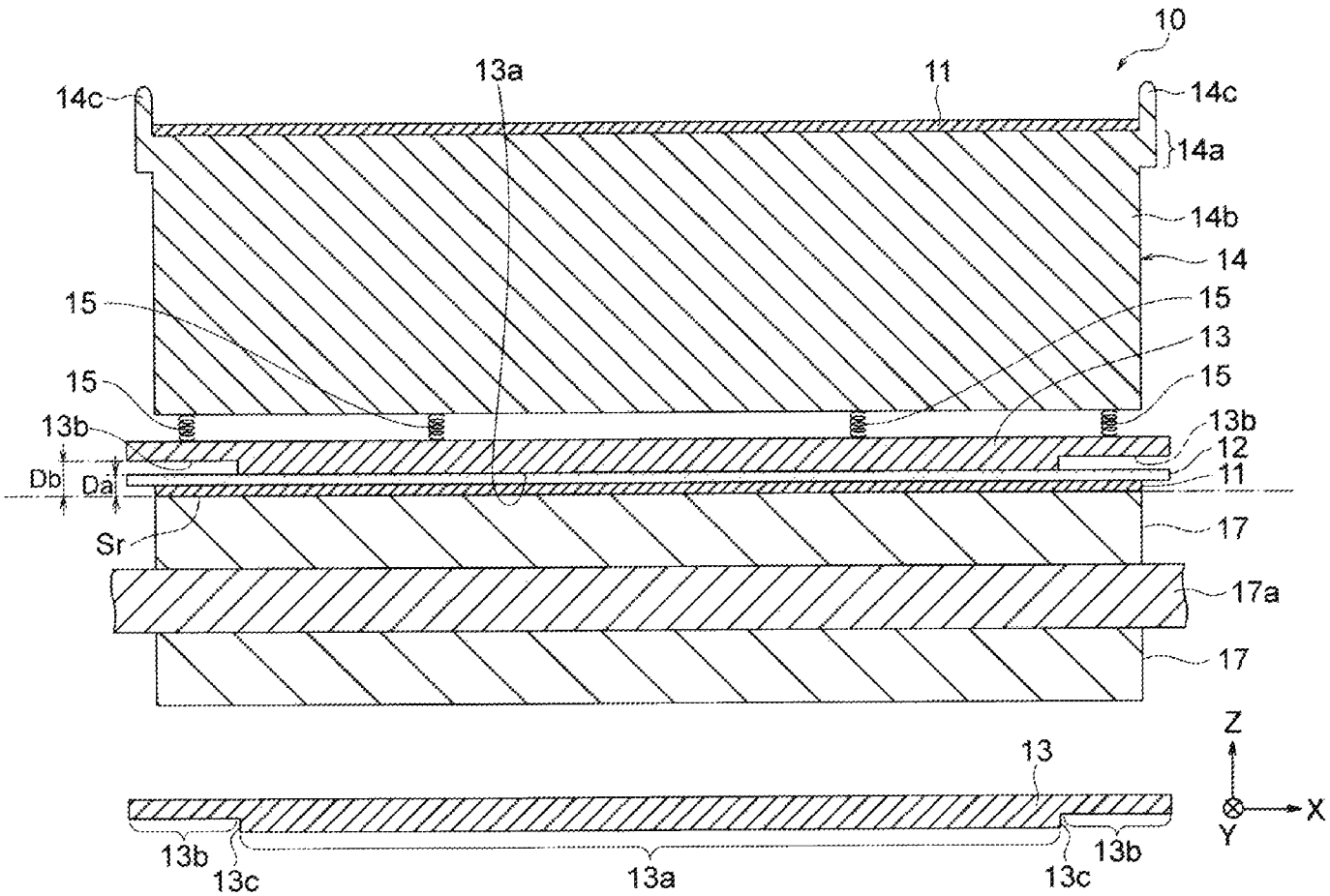
FIG. 3A is a cross-sectional diagram of the fixation device depicted in FIG. 2, and illustrates a cross section cut along a line I-I.
FIG. 3B is a cross-sectional diagram illustrating a support member in FIG. 3A.
Figure 4:
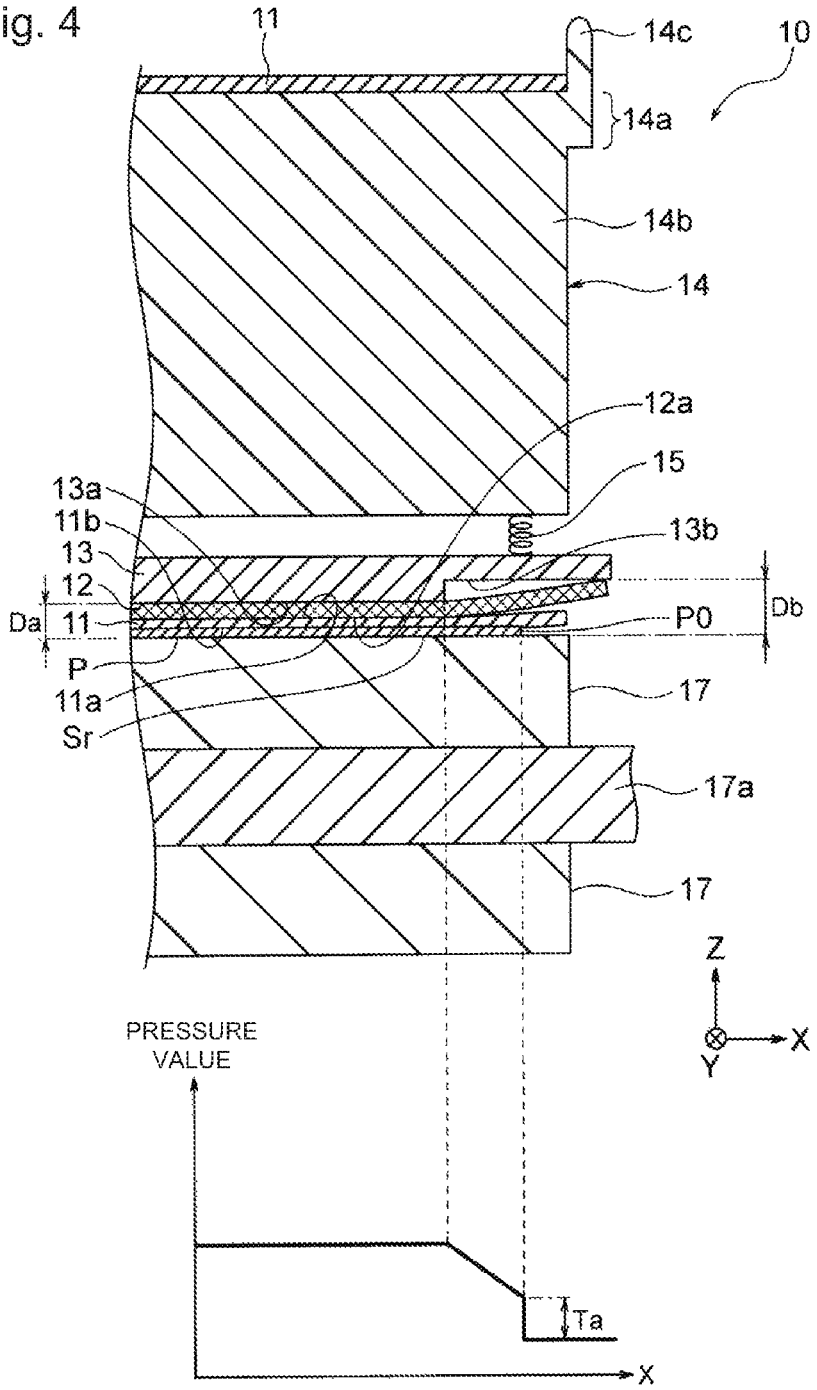
FIG. 4 illustrates a cross section of the fixation device depicted in FIG. 3 and a graph schematically illustrating a distribution of the pressure applied to a fixation belt.

Subsequently, the configuration of fixation device 10 is described in detail with reference to FIG. 2 to FIG. 4. FIG. 2 is a vertical cross-sectional diagram schematically illustrating a main part of an example configuration of fixation device 10; FIG. 3A is a cross-sectional diagram of fixation device 10 depicted in FIG. 2, which illustrates a cross section cut along a line I-I; FIG. 3B is a cross-sectional diagram illustrating a support member in fixation device 10; and FIG. 4 is a diagram illustrating a cross section of fixation device 10 depicted in FIG. 3A (immediately before printing medium P passes, as it is being conveyed in conveyance direction D2 indicated in FIGS. 1 and 2).

Fixation device 10 illustrated in FIG. 2 includes fixation belt 11, resistance wire heater 12, heater support member 13, and drive roller 17, and fuses developer image Tn on printing medium P as printing medium P is being conveyed. A fixation device such as fixation device 10 is called a fixation device in a SURF system. Note that although fixation device 10 illustrated in FIG. 2 has a configuration where fixation belt 11 is disposed on the upper side relative to drive roller 17, fixation belt 11 may be installed at a position other than on the upper side of drive roller 17 as long as fixation belt 11 is opposite to drive roller 17 (for example, on the lower side or lateral side of drive roller 17).

Fixation belt 11 is an endless belt and can be formed in, for example, a three-layer structure including a polyimide layer as a base material, an elastic layer of silicone rubber as an intermediate layer, and a perfluoroalkoxy alkane (PFA) tube as a surface layer. Fixation belt 11 is supported by cylindrical belt support member 14, as illustrated in FIG. 2. An outer surface (outer peripheral surface) of fixation belt 11 comes into contact with printing medium P at a fixation position indicated by nip region NP in FIG. 2, as printing medium P is being conveyed.

Both ends in an X-axis direction of belt support member 14 are attached to a housing for the body of fixation device 10 or to a housing for image formation apparatus 100 using a not-illustrated mechanism. Additionally, belt support member 14 is a member which runnably retains fixation belt 11 and limits the displacement in the width direction (X-axis direction) of rotating fixation belt 11.

Belt support member 14 illustrated in FIG. 2 and FIG. 3A includes: cylindrical portion 14*a* opened in a region including the fixation position indicated by nip region NP; plate-shaped member 14*b* formed to extend from an inner wall of the portion located at the top of cylindrical portion 14*a* toward the fixation position (along the Z-axis direction); and flange portions 14*c* formed at both end portions in the X-axis direction of the outer peripheral surface of cylindrical portion 14*a*. Note that the structure of belt support member 14 is not limited to that illustrated in FIG. 2 and FIG. 3A.

Cylindrical portion 14*a* is a portion which runnably retains fixation belt 11. Meanwhile, fixation belt 11 is disposed to rotate by being driven by the rotational drive of drive roller 17. For these reasons, fixation belt 11 is supported by cylindrical portion 14*a* in a loose state (in a slack state) along the outer peripheral surface of cylindrical portion 14*a*. Note that the displacement in the width direction (i.e., in the X-axis direction) of fixation belt 11 is limited by flange portions 14*c* formed at both end portions in the X-axis direction of cylindrical portion 14*a*. As described above, fixation belt 11 is disposed on belt support member 14 in order not to be displaced, also while rotating, in the X-axis direction at the fixation position. Incidentally, plate-shaped member 14*b* is a member to which biasing springs 15 to be described later are attached.

In addition, it is possible to provide belt support member 14 with a mechanism to supply lubricant between the outer peripheral surface of cylindrical portion 14*a* and an inner peripheral surface of fixation belt 11, and to collect unnecessary lubricant, for example. Moreover, this lubricant is also capable of reducing the resistance between resistance wire heater 12 to be described later and the inner peripheral surface of fixation belt 11. This makes it possible to rotate fixation belt 11 smoothly on an outer periphery of cylindrical portion 14*a*.

As illustrated in FIG. 4, resistance wire heater 12 is an example of a contact member having contact surface 12*a* in contact with inner surface (inner peripheral surface) 11*a* of fixation belt 11 at the fixation position. This contact member is a member contact surface 12*a* of which in a region (first region) corresponding to end portion P0 in the width direction (a direction perpendicular to the conveyance direction of printing medium P, i.e. the X-axis direction) of printing medium P is displaceable in a direction (in a +Z direction) away from inner surface 11*a* of fixation belt 11 at the fixation position. Here, the contact member may be such a member that a contact surface thereof not in the first region is also displaceable, for example a member uniform in the width direction. What is more, although resistance wire heater 12 has a rectangular shape in the YZ-plane and the contact surface thereof has a horizontal shape in the YZ-plane, the shape of the contact member in the YZ-plane is not particularly limited. For example, the shape of the contact surface in the YZ-plane may be an arc.

Resistance wire heater 12, which is an example of the contact member, may include a metal base material, an insulating layer formed on the base material, and a resistance wire as a heat emitter provided in the insulating layer. In this configuration, resistance wire heater 12 may be installed such that the insulating layer thereof comes into contact with the inner surface of fixation belt 11, or the base material thereof comes into contact with the inner surface of fixation belt 11. As described above, the contact member may include a metal base material.

Heater support member 13 is an example of a support member which includes a support surface supporting the contact member, and is a member which includes a support surface supporting resistance wire heater 12 in the example illustrated in FIG. 2 and in FIGS. 3A and 3B. This support surface is described later. As illustrated in FIG. 2, heater support member 13 may be a member which retains both ends in the Y-axis direction of resistance wire heater 12. Note that also in this case, heater support member 13 does not retain resistance wire heater 12 at both ends in the X-axis direction of resistance wire heater 12, and allows the displacement of resistance wire heater 12 in the +Z direction.

Both ends in at least one of the X-axis direction and the Y-axis direction of heater support member 13 are supported by a not-illustrated mechanism. Heater support member 13 is biased in the −Z direction by a biasing mechanism including biasing springs 15 while supporting resistance wire heater 12 on the support surface, to be described later. Plate-shaped member 14*b* is a member including a part to which these biasing springs 15 are attached. In other words, heater support member 13 illustrated in FIG. 2 and in FIGS. 3A and 3B is biased with belt support member 14 as a base point, which is a member on the inner peripheral side of fixation belt 11. In the example illustrated in FIG. 3A, four biasing springs 15 are arranged in the X-axis direction on the surface of plate-shaped member 14*b* located farthest in the −Z direction.

Besides, fixation device 10 can be configured such that the width of heater support member 13 is larger than that of fixation belt 11 and thereby heater support member 13 is biased by external members. In this case, belt support member 14 and the heater support member can be connected to each other so as to be biased together, i.e., the heater support member can be formed to constitute a part of belt support member 14. Here, heater support member 13 does not need to be biased by a biasing mechanism, and may be provided at a fixed position in fixation device 10. In that case, it suffices to provide, on the drive roller 17 side to be described later, a biasing mechanism to press drive roller 17 against resistance wire heater 12 and heater support member 13 (in other words, it suffices to configure drive roller 17 as a biasing roller). Any of the above configurations makes it possible to pinch (nip) printing medium P using fixation belt 11 and drive roller 17 at the fixation position. Incidentally, it is possible to employ a configuration of fixation device 10 where biasing is performed by both heater support member 13 and drive roller 17 using the respective biasing mechanisms.

Next, the support surface of heater support member 13 is described. As illustrated in FIG. 3A, this support surface has such a shape that second distance Db is larger than first distance Da in order to form a space for the displacement in the +Z direction of the first region of resistance wire heater 12. Note that although both of first distance Da and second distance Db compared to each other are defined based on the shortest distance (distance in the Z-axis direction) as illustrated in FIG. 3A and FIG. 4, they may be defined based on the lengths of straight lines parallel to each other, for example.

Here, first distance Da denotes the distance from reference passage surface Sr of printing medium P to a position on the support surface of the central portion in the width direction (the X-axis direction) of printing medium P. The above-described position on the support surface of the central portion refers to a position on central portion support surface (first support surface) 13*a* illustrated in FIGS. 3A and 3B and FIG. 4. Central portion support surface 13*a* is a surface which is in contact with resistance wire heater 12 to support resistance wire heater 12. Meanwhile, second distance Db denotes the distance from reference passage surface Sr of printing medium P to a position on the support surface of each of the end portions in the width direction (X-axis direction) of printing medium P. The above-described positions on the support surface of the end portions refer to positions on end portion support surfaces (second support surfaces) 13*b* illustrated in FIGS. 3A and 3B and in FIG. 4. Each end portion support surface 13*b* is a surface which is not in contact with resistance wire heater 12 and does not support resistance wire heater 12, at least in a state where resistance wire heater 12 is not displaced in the Z-axis direction. To put it differently, resistance wire heater 12 is deformable in the regions opposite to end portion support surfaces 13*b*. In the regions opposite to end portion support surfaces 13*b*, the displacement amount of resistance wire heater 12 in the Z-axis direction is limited to a predetermined amount by the contact of end portions of resistance wire heater 12 in the X-axis direction and end portion support surfaces 13*b*. Namely, end portion support surfaces 13*b* are displacement restricting surfaces which restrict the displacement of resistance wire heater 12 in the Z-axis direction. Additionally, heater support member 13 includes step portions 13*c* that connect central portion support surface 13*a* and end portion support surfaces 13*b* together.

Note that end portion P0 in the width direction of printing medium P may indicate, but is not limited to, an extreme end portion. End portion P0 may indicate an area including a portion closer to the center to some extent with respect to the extreme end portion. What is more, as illustrated in FIG. 4, reference passage surface Sr may be defined by the surface on the drive roller 17 side when printing medium P is passing. However, reference passage surface Sr may be defined by the surface on the fixation belt 11 side when printing medium P is passing, or an intermediate surface in the thickness direction of passing printing medium P when printing medium P is passing, for example.

The positional relationship in the X-axis direction is not limited among the end portions in the width direction of resistance wire heater 12, the end portions in the width direction of fixation belt 11, the end portions in the width direction of heater support member 13, and the end portions in the width direction of drive roller 17. However, in order to form a space for the displacement in the +Z direction of resistance wire heater 12 in the first region regardless of the positional relationship among these, it suffices to satisfy such a condition that, as illustrated in FIG. 3A and FIG. 4, all of the end portions in the width direction of resistance wire heater 12, fixation belt 11, and drive roller 17 protrude outwardly in the width direction (X-axis direction) beyond the end portions in the width direction of central portion support surface 13*a* of heater support member 13, in addition to the condition of providing heater support member 13 satisfying Db>Da. To be more specific, when the end portions in the width direction of fixation belt 11 and drive roller 17 protrude outwardly in the X-direction beyond the end portions in the width direction of central portion support surface 13*a*, nip region NP includes, in the X-axis direction, at least part of the regions corresponding to end portion support surfaces 13*b*, as well as the region corresponding to central portion support surface 13*a*. Moreover, when the end portions in the width direction of resistance wire heater 12 protrude outwardly in the X-axis direction beyond the end portions in the width direction of central portion support surface 13*a*, resistance wire heater 12 has portions overlapping end portion support surfaces 13*b* in the Z-axis direction and displacement thereof in the +Z direction is possible.

Drive roller 17 can be formed in, for example, a three-layer structure including a core bar at the center, an elastic layer of silicone rubber as an intermediate layer, and a PFA tube as a surface layer. Also, as illustrated in FIG. 3A and FIG. 4, drive roller 17 is in contact with outer surface 11*b* of fixation belt 11 at the fixation position. Additionally, drive roller 17 has a configuration such that both ends of rotation shaft 17*a* are retained by a retention mechanism (not illustrated) capable of rotation, and that it is possible to give a rotational motion to drive roller 17 in a desired manner from driver 21 to be described later. Rotation shaft 17*a* may be the core bar part at the center, for example. Here, it is possible to bias drive roller 17 to the fixation belt 11 side by providing a mechanism to bias the bearing parts of rotation shaft 17*a* in the +Z direction. In this case, drive roller 17 is a biasing roller.

Furthermore, fixation device 10 may include temperature sensor 16 which detects the temperature of fixation belt 11, as illustrated in FIG. 2. Note that the position of temperature sensor 16 in fixation device 10 is not limited to the one illustrated in FIG. 2. The temperature detected by temperature sensor 16 is used to control resistance wire heater 12.

Figure 5:
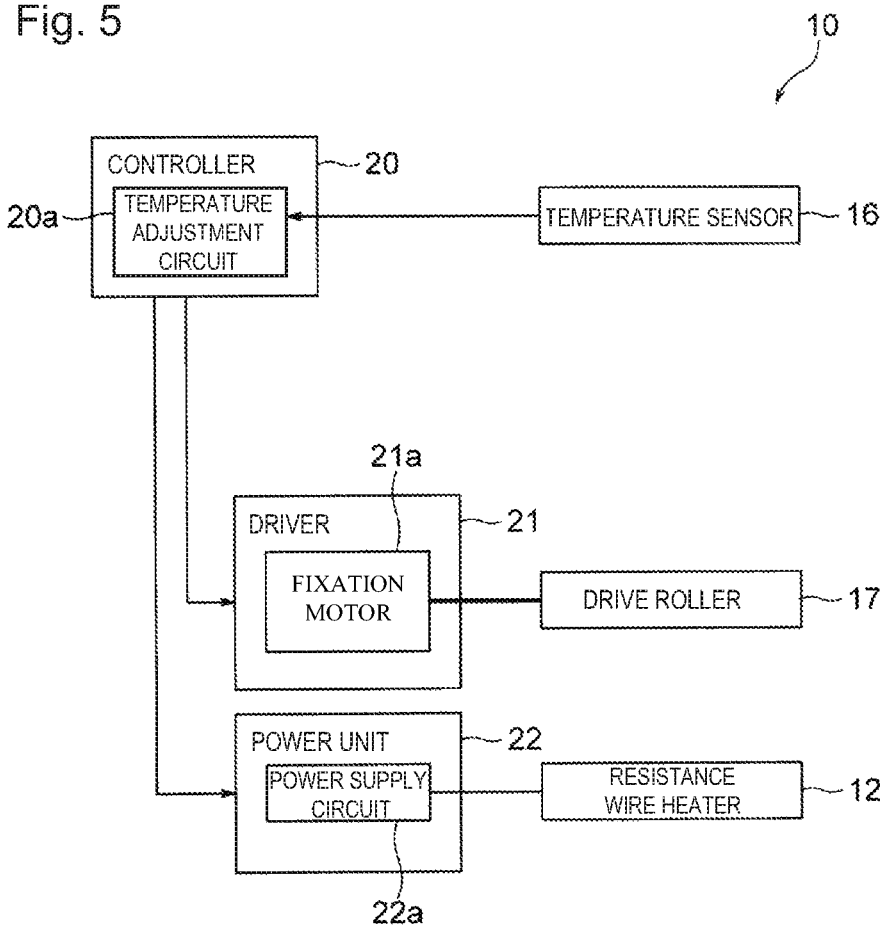
FIG. 5 is a block diagram illustrating examples of components for performing a control in the fixation device depicted in FIG. 2.

Hereinbelow, the control of fixation device 10 is described with reference to FIG. 5, including the control of resistance wire heater 12. FIG. 5 is a block diagram illustrating examples of components for performing the control in fixation device 10 as depicted in FIG. 2 to FIG. 4.

As illustrated in FIG. 5, fixation device 10 may include controller 20, driver 21, and power unit 22. Controller 20 includes, for example, a central processing unit (CPU) and controls the operation of fixation device 10. Note that controller 20 is connected to, or is included in, a main controller (not illustrated) which controls the operation of image formation apparatus 100.

Temperature sensor 16 detects (monitors) the temperature of fixation belt 11 and sends controller 20 temperature information indicating the temperature of fixation belt 11 obtained as a result of the monitoring. Controller 20 includes temperature adjustment circuit 20*a* which outputs to power unit 22 an instruction to adjust the temperature of resistance wire heater 12 based on the temperature information received from temperature sensor 16. Driver 21 includes motor (fixation motor) 21*a*. Fixation motor 21*a* supplies driving power to drive roller 17 in accordance with the instruction from controller 20. Power unit 22 includes power supply circuit 22*a*. Power supply circuit 22*a* supplies electric power to resistance wire heater 12 in accordance with the instruction from controller 20. It is possible to cause resistance wire heater 12 to generate heat by allowing an electric current to flow through the resistance wire from power supply circuit 22*a*. Note that power supply circuit 22*a* also supplies electric power to temperature sensor 16.

When developer image Tn of printing medium P is to be fused, controller 20 of fixation device 10 first performs a control such that fixation belt 11 has a sufficient amount of heat in order to fuse (thermocompression bond) developer image Tn on printing medium P. To be more specific, temperature adjustment circuit 20*a* outputs to power supply circuit 22*a* an instruction to allow an electric current to flow through resistance wire heater 12 (ON-state). Thus, resistance wire heater 12 generates heat. The heat generated from resistance wire heater 12 is transmitted to fixation belt 11 in contact with resistance wire heater 12, thereby heating fixation belt 11.

Moreover, controller 20 outputs to driver 21 an instruction to drive roller 17 simultaneously with, before, or after the control to cause resistance wire heater 12 to generate heat. Thus, fixation motor 21*a* drives drive roller 17 and drive roller 17 initiates a rotational motion. When drive roller 17 initiates the rotational motion, driving power is transmitted to fixation belt 11 and a rotational motion of fixation belt 11 is initiated.

Controller 20 determines whether or not fixation belt 11 has a sufficient amount of heat based on the temperature information received from temperature sensor 16. When it is determined that fixation belt 11 has a sufficient amount of heat, controller 20 transmits a signal indicating that fact to the main controller of image formation apparatus 100 illustrated in FIG. 1. After receiving the signal, the main controller instructs conveyer 120 to convey printing medium P to fixation device 10. Printing medium P conveyed to fixation device 10 is heated and pressed in nip region NP, and developer image Tn on printing medium P is fused.

Subsequently, a description is provided for a preferable example of a boundary position between central portion support surface 13*a* and each of end portion support surfaces 13*b*. The region corresponding to end portion P0 in the width direction of printing medium P, which is used as a reference in the definition of second distance Db, is preferably a region corresponding to an end portion in the width direction of printing medium P having a predetermined size. In this case, the above-described boundary position is a position inside of the extreme end portion in the width direction of printing medium P having the predetermined size, as illustrated in FIG. 4.

Figure 10:
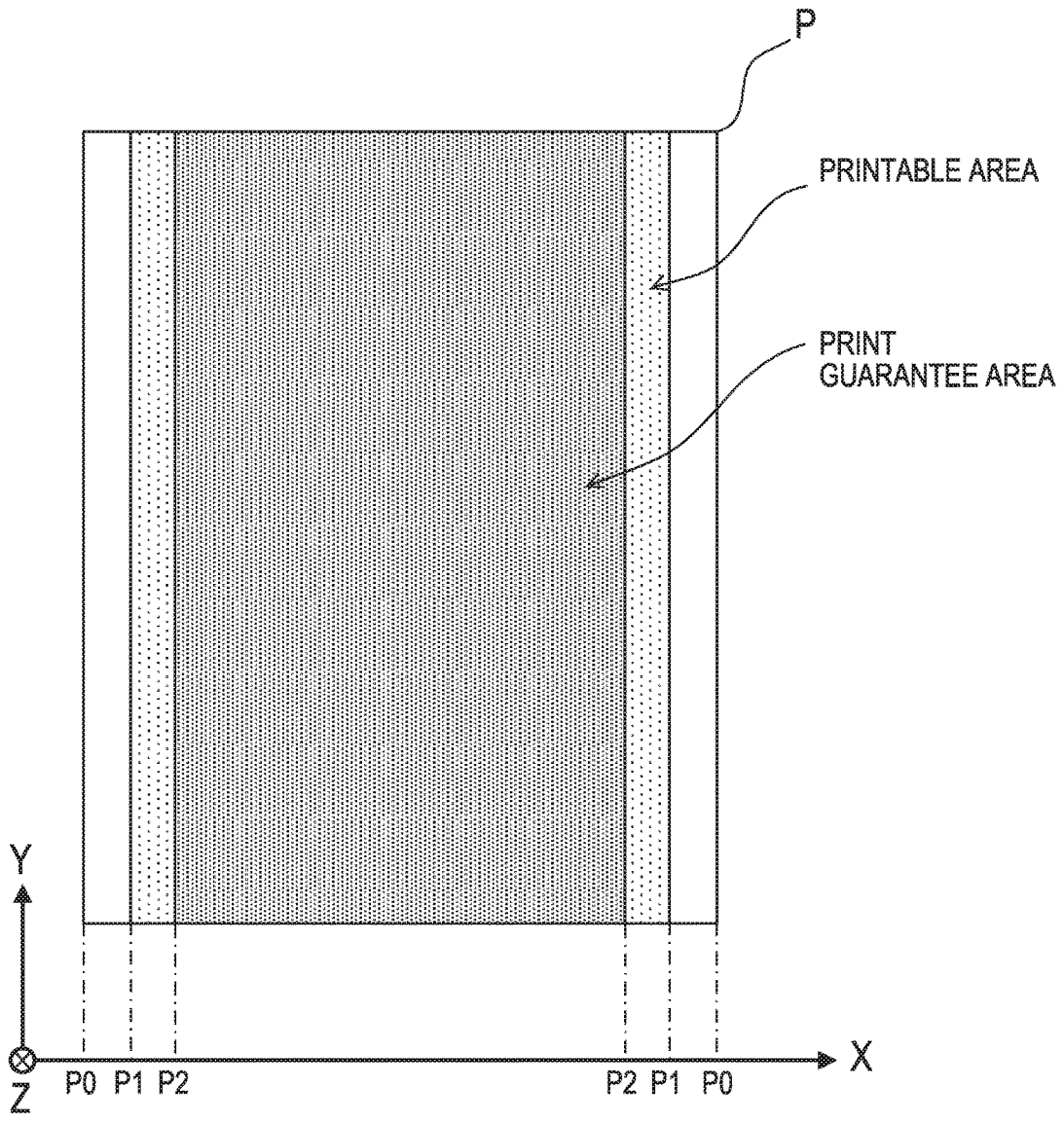
FIG. 10 is a plan view of a printing medium, which illustrates a print guarantee area and a printable area.

A specific example of the boundary position between central portion support surface 13*a* and each of end portion support surfaces 13*b* is described using FIG. 10. FIG. 10 is a plan view of printing medium P, which illustrates a print guarantee area and a printable area. Note that printing medium P illustrated in FIG. 10 is a medium having a maximum width which is allowed to pass through fixation device 10. The print guarantee area is an area where the print quality is guaranteed. The printable area is an area where printing is possible, although the print quality may be low. In other words, the print guarantee area is an area where printing failures such as deterioration in print density are less likely to occur than in the printable area. As illustrated in FIG. 10, print guarantee area is set within the surface region of printing medium P. The printable area is set within the surface region of recording medium P, and outside the print guarantee area. Here, the boundary position between central portion support surface 13*a* and each of end portion support surfaces 13*b* is set in the printable area. Specifically, in the width direction (X-axis direction) of printing medium P, the boundary position is set between each of end portions P1 on an outer end portion of the printable area and corresponding end portion P2 of the print guarantee area, as illustrated in FIG. 10.

Note that a margin of printing medium P may not be provided although FIG. 10 illustrates a margin between the printable area and the end portions P0 of printing medium P.

In addition, this boundary position is preferably set such that developer image Tn in any of the regions can be uniformly fused when developer image Tn on printing medium P is to be fused onto printing medium P. Accordingly, it is preferable that the predetermined size mentioned here be the maximum size on which fixation device 10 can perform the fixation. Note that since fixation can be performed even when resistance wire heater 12 is deformed due to, for example, an adjustment of fixation temperature, the predetermined size is not limited to the above-described maximum size.

Figure 6:
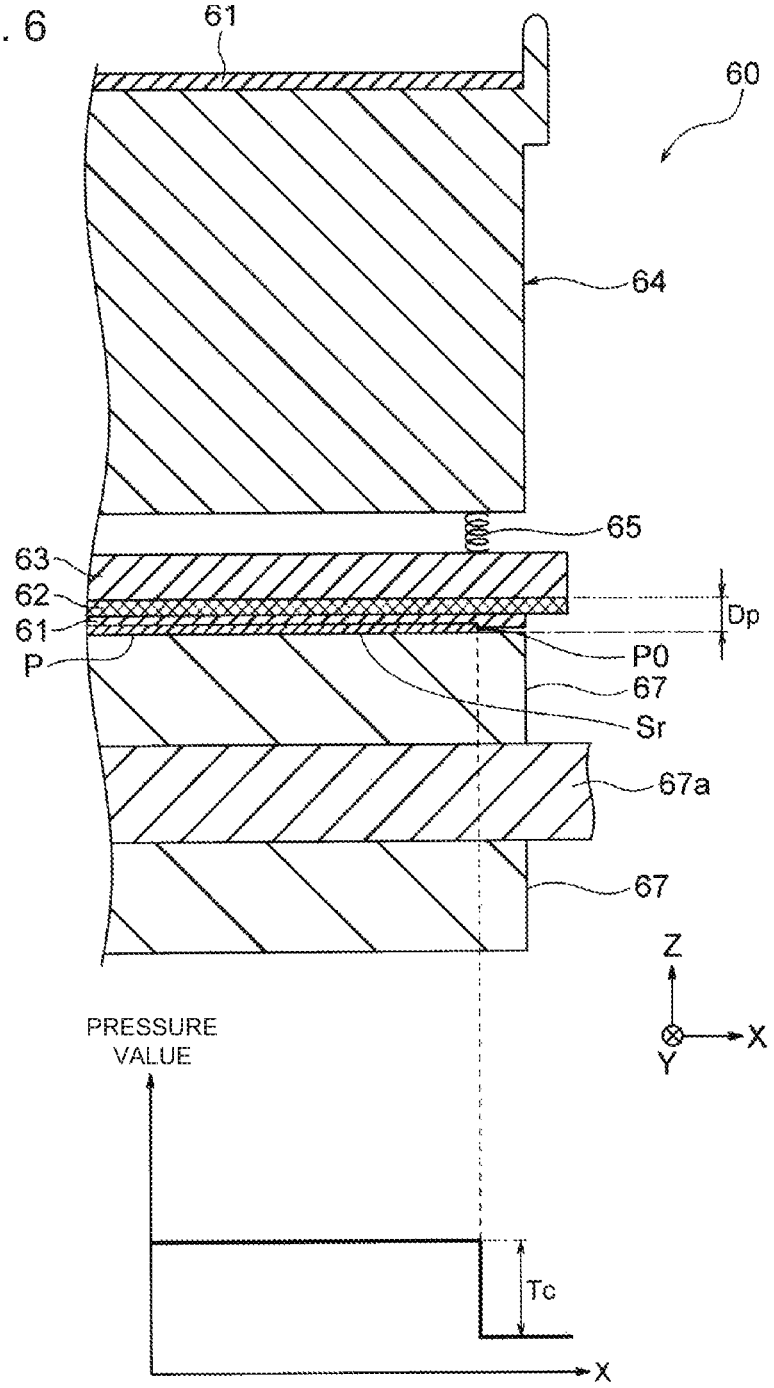
FIG. 6 illustrates a cross section of a fixation device according to a comparative example and a graph schematically illustrating a distribution of the pressure applied to a fixation belt.

Subsequently, deformation of fixation belt 11 at the fixation position when printing medium P passes is described with reference to FIG. 4 and FIG. 6. FIG. 4 also illustrates a graph schematically illustrating a distribution of the pressure applied to fixation belt 11 when printing medium P passes in fixation device 10. FIG. 6 illustrates a cross section (when printing medium P passes) of fixation device 60 according to a comparative example and a graph schematically illustrating a distribution of the pressure applied to fixation belt 61.

Here, fixation device 60 according to the comparative example illustrated in FIG. 6 is fixation device 10 according to Embodiment 1 illustrated in FIG. 4 where heater support member 13 is replaced by heater support member 63 which has a distance Dp from the reference passage surface Sr to the contact surface, the distance being constant along the X-axis direction. In addition to heater support member 63, fixation device 60 includes fixation belt 61, resistance wire heater 62, belt support member 64, biasing springs 65, and drive roller 67 including rotation shaft 67*a*.

As illustrated in FIG. 6, in fixation device 60, there is a large pressure difference at the contact portion between the end portion of printing medium P and fixation belt 61, depending on the thickness of printing medium P. In other words, in fixation device 60 including heater support member 63 which has distance Dp constant along the X-axis direction, there is a large pressure difference Tc between a region on fixation belt 61 corresponding to end portion P0 in the width direction of printing medium P and a region on fixation belt 61 corresponding to the central portion in the width direction of printing medium P when, for example, the developer on thick printing medium P is fused. Such a pressure difference wrinkles the surface layer of fixation belt 61, which may cause damage in fixation belt 61. Note that the problem described above could arise regardless of the shape in the YZ-plane of the fixation nip surface (nip region NP) of fixation device 60.

In fixation device 10 according to Embodiment 1, on the other hand, resistance wire heater 12 is warped when the pressure difference occurring at the end portion of printing medium P is large as illustrated in FIG. 4, making it possible to reduce the pressure difference which occurs at the contact portion between the end portion of printing medium P and fixation belt 11. Comparison reveals that pressure difference Ta illustrated in FIG. 4 is lower than pressure difference Tc in the comparative example illustrated in FIG. 6.

Table 1 provides the results of a test conducted to make a comparison of such pressure differences between fixation device 10 according to Embodiment 1 and fixation device 60 according to the comparative example. As fixation belt 11 and fixation belt 61, this test uses a fixation belt having the above-described structure where a PFA tube is used in the belt surface layer, etc. In addition, each of resistance wire heater 12 and resistance wire heater 62 used is an elastic thin metal film with a thickness of 300 μm as the base material to which a 50-μm-thick insulating layer with a built-in heat resistor (10 μm in thickness) is attached. Heater support member 13 used has a step with a 1-mm depth (height) formed from a position on the inner side 5 mm away from the end portion of printing medium P to the end of heater support member 13, in comparison with heater support member 63.

TABLE 1

| | Printing medium of basis weight 120 g/m$^2$ | Printing medium of basis weight 220 g/m$^2$ | Printing medium of basis weight 350 g/m$^2$ |
|---|---|---|---|
| Pressure difference at end portions in width direction of printing medium occurring in fixation device 60 (comparative example) | 1027 g/cm$^2$ | 1913 g/cm$^2$ | 2607 g/cm$^2$ |
| Pressure difference at end portions in width direction of printing medium occurring in fixation device 10 (Embodiment 1) | 512 g/cm$^2$ | 1080 g/cm$^2$ | 1591 g/cm$^2$ |

As a result of this test, it can be said that fixation device 10 is capable of reducing the pressure difference attributed to the end portion of printing medium P to almost half, compared to fixation device 60 as illustrated in Table 1. Moreover, it can be said that an allowable range for the wrinkles in the fixation belt after 150000 printing media P are passed in sequence is, for example, equal to or less than 1900 g/cm$^2$. Hence, it can be understood that even in the case of a printing medium P with a basis weight of, for example, 350 g/m$^2$, fixation device 10 is capable of suppressing wrinkles in fixation belt 11, after 150,000 printing media P are passed in sequence, to an allowable range.

As described above, end portion support surfaces 13*b* are formed in heater support member 13 of fixation device 10, each of which is more distant from reference passage surface Sr than is central portion support surface 13*a*. Thus, fixation device 10 reduces the pressure difference on fixation belt 11 which occurs at end portions P0 in the width direction of printing medium P, and suppresses any deformation of fixation belt 11 (the elastic layer and the surface layer being constituents thereof), making it possible to perform uniform fixation (stable fixation) in any region on printing medium P.

It is to be noted that although resistance wire heater 12 including a heat emitter is taken as an example of the contact member in the description above, the contact member may have a configuration where a heat generation member (heat source member) such as a resistance wire heater is included therein. As mentioned above, in terms of thermal efficiency, a preferable contact member is a heat generation member itself, or includes a heat generation member. However, it suffices that the heat generation member provided to the fixation device can supply heat to fixation belt 11, and thus heat generation member can be provided separately from the contact member. Meanwhile, although fixation device 10 includes resistance wire heater 12 as a heat generation member, fixation device 10 may include a heat generation member of a different type, such as a radiation lamp or a magnetic field generating member, as a substitute heat generation member for resistance wire heater 12. In that case as well, the heat generation member can be provided to the contact member, or can be provided separately from the contact member.

An example is taken in the description above where central portion support surface 13*a* and each of end portion support surfaces 13*b* form one step at an end portion of support member 13, corresponding to end portion P0 in the width direction of printing medium P illustrated in FIGS. 3A and 3B, and FIG. 4 (two steps in total are formed at both end portions). However, it is possible that heater support member 13 has steps formed at multiple positions at each of both end portions of the support surface thereof, where fixation belt 11 is easily subjected to concentrated stress attributed to printing medium P. For example, the steps at the multiple positions described above may be ones for each size of printing media P to be passed through fixation device 10 (in other words, steps for each size of printing media P supported by the image formation apparatus 100 illustrated in FIG. 1), or may be ones for each size that is frequently used in image formation apparatus 100. Note that as described above, one of the steps is preferably set corresponding to the maximum size which fixation device 10 can perform fixation on.

Further, the fixation device according to Embodiment 1 is not limited to a fixation device in the SURF system such as fixation device 10, and may be, for example, a fixation device employing another fusing method such as free belt nip fusing. An example configuration of a fixation device employing free belt nip fusing may be such that the fixation device 10 illustrated in FIG. 2 has a heat generation member such as resistance wire heater 12 provided to the drive roller 17 side, not to the fixation belt side, and drive roller 17 is made to function as a fixation roller. Here, a contact member not including a heat generation member is brought into contact with the inner peripheral surface of the belt (this belt can also be termed a fixation belt since it is used for fixation) driven by the fixation roller.

According to Embodiment 1, a space which allows for displacement of the contact member such as resistance wire heater 12 is formed on the inner surface side in the width direction of the contact member, as described above. This makes it possible to reduce (moderate) the pressure difference on fixation belt 11 occurring locally at the end portions of printing medium P, and thereby to suppress any deformation of fixation belt 11. Such deformation is unlikely to occur in Embodiment 1, which allows developer image Tn in any of the regions on printing medium P to be uniformly fused (stably fused), and allows for an extended lifetime of fixation belt 11.

Embodiment 2

Figures 7A, 7B:
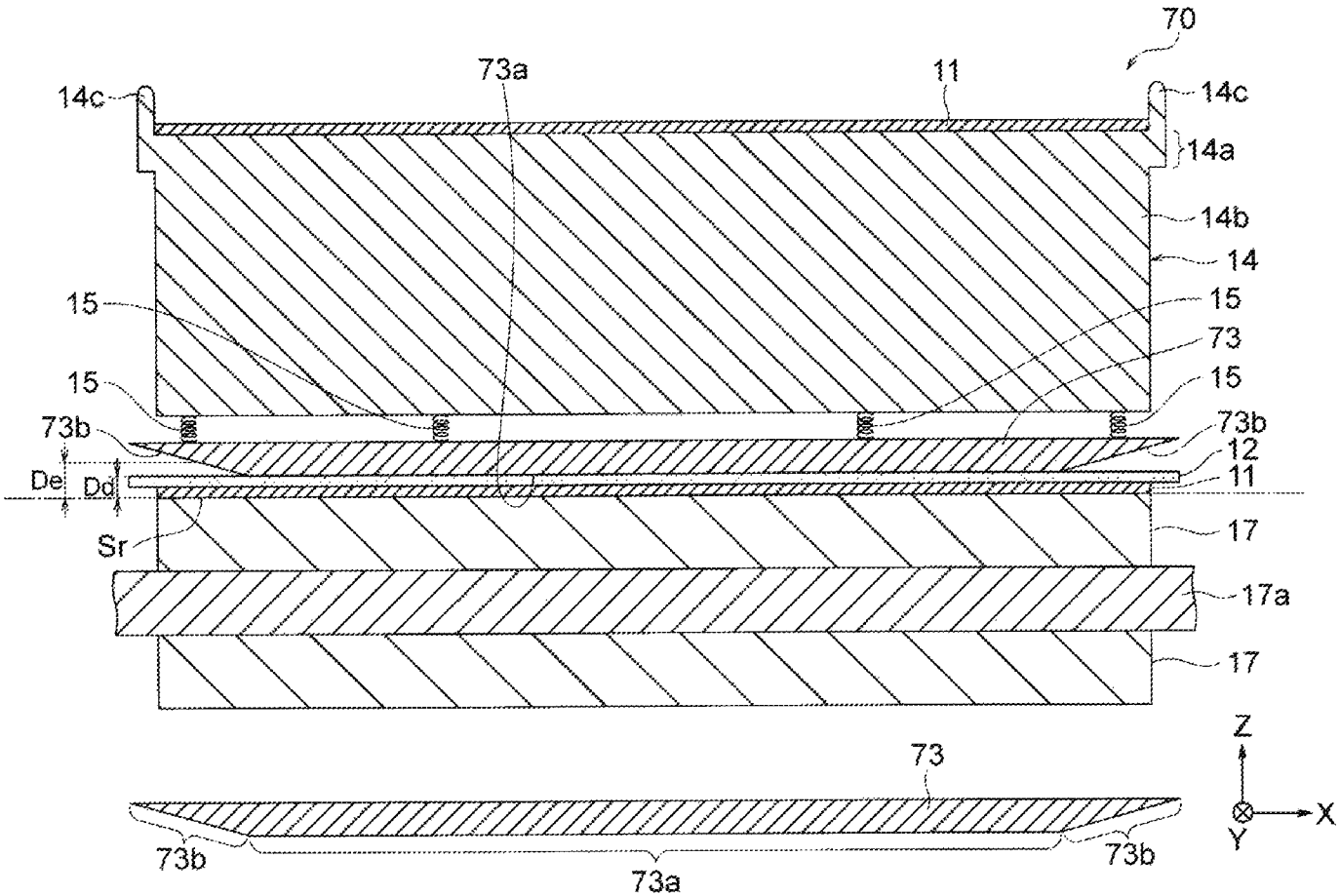
FIG. 7A is a cross-sectional diagram illustrating an example configuration of a fixation device according to Embodiment 2.
FIG. 7B is a cross-sectional diagram illustrating a support member in FIG. 7A.

FIG. 7A is a cross-sectional diagram illustrating an example configuration of a fixation device according to Embodiment 2, and FIG. 7B is a cross-sectional diagram illustrating a support member in the fixation device. In FIGS. 7A and 7B, parts having functions the same as or corresponding to those in FIGS. 3A and 3B are assigned the same reference numerals used in FIGS. 3A and 3B. Note that although FIG. 7A does not illustrate printing medium P, but a cross section corresponding to the cross section depicted in FIG. 3A, printing medium P passes on reference passage surface Sr. Hereinbelow, Embodiment 2 is described mainly focusing on the differences from Embodiment 1. Various examples described in Embodiment 1 can be applied to Embodiment 2.

Fixation device 10 according to Embodiment 1 has one step at each of both end portions in the width direction of heater support member 13. On the other hand, fixation device 70 according to Embodiment 2 illustrated in FIG. 7A has a tapered shape (inclined portion), instead of this step, at each of both end portions in the width direction of the heater support member.

As illustrated in FIGS. 7A and 7B, fixation device 70 includes heater support member 73 with each of both end portions in the width direction formed in such a tapered shape that second distance De is larger than first distance Dd. Here, as in the case of first distance Da illustrated in FIG. 3A, first distance Dd denotes the distance from reference passage surface Sr in contact with printing medium P to a position on the support surface of the central portion in the width direction (X-axis direction) of printing medium P. The above-described position on the support surface of the central portion refers to a position on central portion support surface (first support surface) 73*a* illustrated in FIGS. 7A and 7B. Central portion support surface 73*a* is a surface which is in contact with resistance wire heater 12 to support resistance wire heater 12.

Meanwhile, as in the case of second distance Db illustrated in FIG. 3A, second distance De denotes the distance from reference passage surface Sr of printing medium P to a position on a support surface of each of the end portions in the width direction (X-axis direction) of printing medium P. The above-described position on the support surface of the end portion refers to a position on each of end portion support surfaces (second support surfaces) 73*b* illustrated in FIGS. 7A and 7B. Here, as an example of this position, FIG. 7A illustrates a position near the center in the X-axis direction of each end portion support surface 73*b*, and depicts distance De as one from that position to reference passage surface Sr. Each of end portion support surface 73*b* is inclined such that the distance from reference passage surface Sr of printing medium P is larger than first distance Dd and second distance De becomes larger toward the corresponding end portion of heater support member 73. In addition, each end portion support surface 73*b* is a surface which is not in contact with resistance wire heater 12 and does not support resistance wire heater 12, at least in a state where resistance wire heater 12 is not displaced in the Z-axis direction. To put it differently, resistance wire heater 12 is deformable in the regions opposite to end portion support surfaces 73*b*. Incidentally, a preferable example of the boundary position between central portion support surface 73*a* and each of end portion support surfaces 73*b* is as described in Embodiment 1.

It is possible to increase a region of each end portion support surface 73*b* illustrated in FIGS. 7A and 7B which comes into contact with resistance wire heater 12 when printing medium P passes, compared to end portion support surfaces 13*b* illustrated in FIGS. 3A and 3B. Hence, in addition to the effects of Embodiment 1, Embodiment 2 disperses pressure applied to the contact member such as resistance wire heater 12, and prevents an excessive local pressure to the contact member such as resistance wire heater 12. Thus, it is possible to extend the lifetime of the contact member.

Embodiment 3

Figure 8:
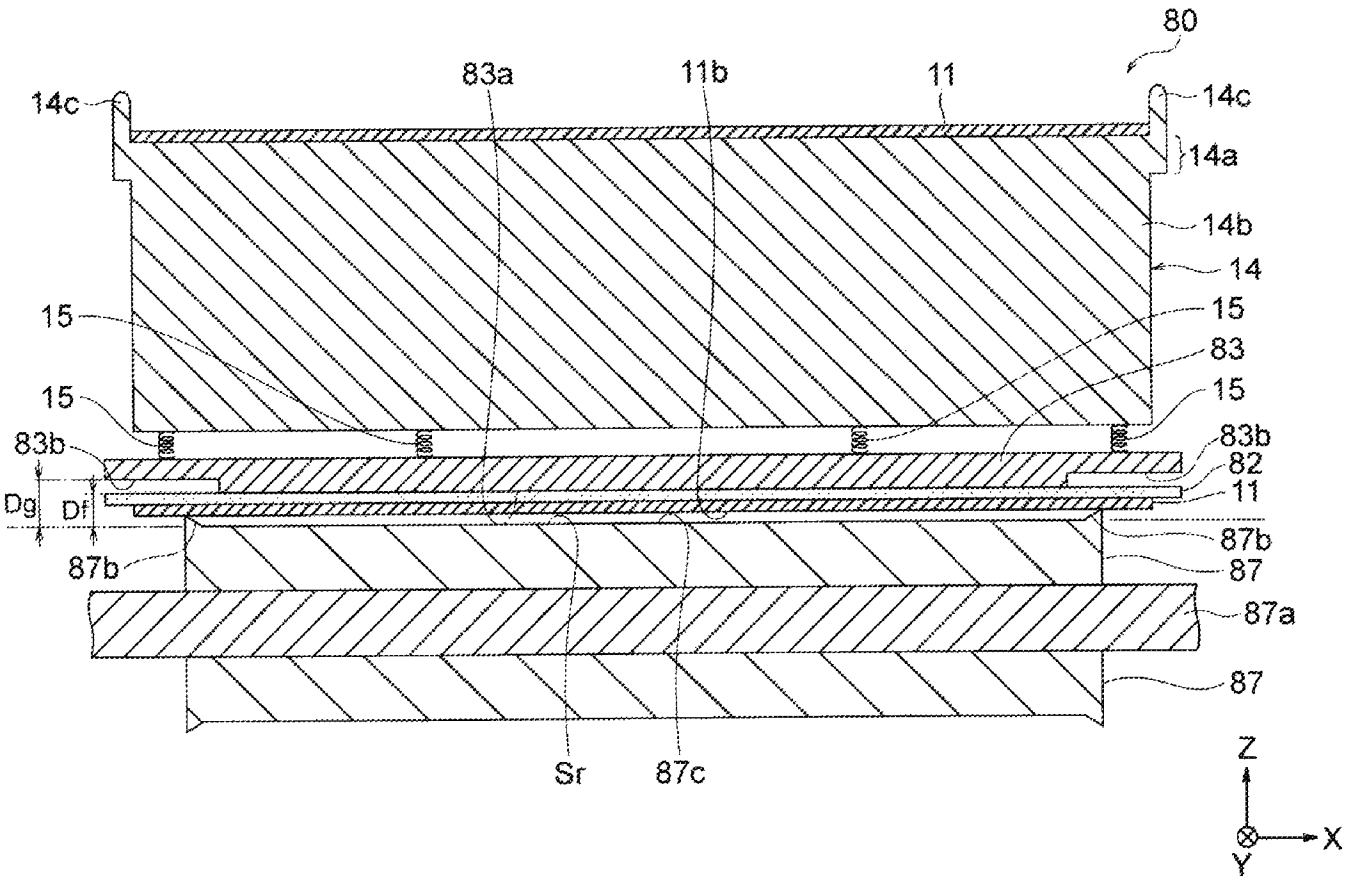
FIG. 8 is a cross-sectional diagram illustrating an example configuration of a fixation device according to Embodiment 3.

FIG. 8 is a cross-sectional diagram illustrating an example configuration of a fixation device according to Embodiment 3. In FIG. 8, parts having functions the same as or corresponding to those in FIG. 3A are assigned the same reference numerals used in FIG. 3A. Note that although FIG. 8 does not illustrate printing medium P, but a cross section corresponding to the cross section depicted in FIG. 3A, printing medium P passes on reference passage surface Sr. Hereinbelow, Embodiment 3 is described mainly focusing on the differences from Embodiment 1. Various examples described in Embodiments 1 and 2 can be applied to Embodiment 3.

As illustrated in FIG. 3A, fixation device 10 according to Embodiment 1 defines first distance Da and second distance Db to be compared with the reference set to each end portion P0 in the width direction of printing medium P, and reduces the pressure difference at the fixation belt attributed to end portions P0 in the width direction of printing medium P. On the other hand, fixation device 80 according to Embodiment 3 illustrated in FIG. 8 reduces the pressure difference in the fixation belt attributed to the end portions in the width direction (direction perpendicular to the direction of travel of the roller) of the roller in contact with the outer surface of the fixation belt.

As illustrated in FIG. 8, fixation device 80 includes resistance wire heater 82 as an example of the contact member and drive roller 87 as an example of the roller in contact with the outer surface 11*b* of fixation belt 11. The contact member in Embodiment 3 includes a contact surface which is in contact with the inner surface of fixation belt 11 at the fixation position, and is a member the contact surfaces of which in the regions corresponding to the end portions in the width direction of the above-described roller are displaceable in a direction away from the inner surface of fixation belt 11.

Drive roller 87 is a roller which rotates around rotation shaft 87*a*, and includes large-diameter portion 87*b* which is formed at each of both ends in the width direction thereof and has a diameter larger than that of central portion 87*c* in the width direction. Each of large-diameter portions 87*b* illustrated in FIG. 8 has a large diameter in a shape tapered toward the corresponding extreme end portion in the width direction. However, the shape is not limited to the above. Note that although FIG. 8 illustrates a state where a gap is formed between fixation belt 11 and central portion 87*c*, fixation device 80 may be configured such that outer surface 11*b* of fixation belt 11 and central portion 87*c* come into contact with each other through biasing even when printing medium P is not passing.

Also, as illustrated in FIG. 8, fixation device 80 includes, as an example of the support member in Embodiment 3, heater support member 83 which has such a shape that second distance Dg is larger than first distance Df. Here, first distance Df denotes the distance from reference passage surface Sr of printing medium P to a position on the support surface of the central portion in the width direction (X-axis direction) of drive roller 87. The above-described position on the support surface of the central portion refers to a position on central portion support surface 83*a* illustrated in FIG. 8. Central portion support surface 83*a* is a surface which is in contact with resistance wire heater 82 to support resistance wire heater 82. The area in the width direction of the above-described central portion may be different from that of central portion 87*c*. In addition, reference passage surface Sr of printing medium P is the outer surface of central portion 87*c* in the width direction of drive roller 87 at the fixation position.

Meanwhile, second distance Dg denotes the distance from reference passage surface Sr of printing medium P to a position on a support surface of each of the end portions in the width direction (X-axis direction) of drive roller 87. The above-described position on the support surface of the end portion refers to a position on each of end portion support surfaces 83*b* illustrated in FIG. 8. Each end portion support surface 83*b* is a surface which is not in contact with resistance wire heater 82 and does not support resistance wire heater 82, at least in a state where resistance wire heater 82 is not displaced in the Z-axis direction. To put it differently, resistance wire heater 82 is deformable in the regions opposite to end portion support surfaces 83*b*.

Note that the above-described end portion in the width direction of drive roller 87 may indicate, but is not limited to, an extreme end portion. The end portion may indicate an area including a portion closer to the center to some extent with respect to the extreme end portion. For example, when each of the above-described end portions in the width direction of drive roller 87 is set to an area including corresponding large-diameter portion 87*b*, it is possible to reduce the pressure difference at a position on fixation belt 11 that is in contact with the vicinity of the boundary between central portion 87*c* and large-diameter portion 87*b*.

According to Embodiment 3, a space which allows for a displacement of the contact member such as resistance wire heater 82 is formed on the inner surface side in the width direction of the contact member, as described above. This makes it possible to reduce (moderate) the pressure difference on fixation belt 11 occurring locally at the end portions of the roller, such as drive roller 87 in contact with outer surface 11*b* of fixation belt 11, and thereby to suppress deformation of fixation belt 11. As in the case of the effects of Embodiment 1, such deformation is unlikely to occur in Embodiment 3, which allows developer image Tn in any of the regions on printing medium P to be uniformly fused, and allows the lifetime of fixation belt 11 to be extended.

Moreover, Embodiment 3 is also applicable not only to fixation device 80 where a roller having large-diameter portions 87*b*, such as drive roller 87, is brought into contact with outer surface 11*b* of fixation belt 11, but also to a fixation device where a roller having a constant diameter in the width direction is brought into contact with outer surface 11*b* of fixation belt 11. The above-described effects of Embodiment 3 can also be obtained in such a fixation device as long as the extreme end portions in the width direction of the fixation belt protrude beyond the extreme end portions in the width direction of the roller.

Furthermore, Embodiment 3 can be combined with Embodiment 1. Specifically, it is possible to obtain the effects of Embodiment 3 described above as well as the effects of Embodiment 1 or 2 by configuring the fixation device according to Embodiment 3 such that each of the end portions in the width direction of the roller and the corresponding end portion in the width direction of the printing medium are aligned with each other in the X-axis direction (such that the region corresponding to end portion P0 in the width direction of printing medium P is the region corresponding to the end portion in the width direction of the roller). In addition, in the fixation device, it is possible to obtain the effects of Embodiment 3 described above as well as the effects of Embodiment 1 or 2 by forming steps at positions corresponding to the end portions in the width direction of the roller and steps at positions corresponding to the end portions in the width direction of the printing medium. In any cases, it is possible to employ the tapered shape or the like instead of the steps, as described in Embodiment 2.

Embodiment 4

Various specific examples of the end portion in the width direction of the support member illustrated as the heater support member are described as Embodiment 4 with reference to FIGS. 9A to 9E. FIGS. 9A to 9E are cross-sectional diagrams illustrating support members in a fixation device according to Embodiment 4. Each of heater support members 91 to 95 illustrated in FIGS. 9A to 9E is applicable as the heater support member in any of Embodiments 1 to 3.

Figure 9A:
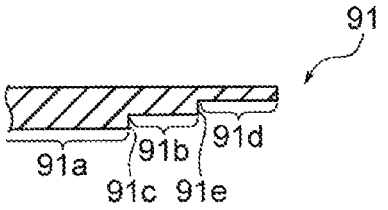
FIGS. 9A to 9E are cross-sectional diagrams illustrating support members in a fixation device according to Embodiment 4.

Heater support member 91 illustrated in FIG. 9A is a member installed to the fixation device in place of the heater support members in Embodiments 1 and 3, and has two steps at each end portion of the support surface in the width direction. Specifically, each of the support surfaces of heater support member 91 is formed from central portion support surface 91*a*, an end portion support surface, and step portion 91*c* between central portion support surface 91*a* and the end portion support surface described above. Meanwhile, the end portion support surface described above is formed from first end portion support surface 91*b* on the step portion 91*c* side, second end portion support surface 91*d* on the opposite side, and step portion 91*e* between first end portion support surface 91*b* and second end portion support surface 91*d*.

Figure 9B:
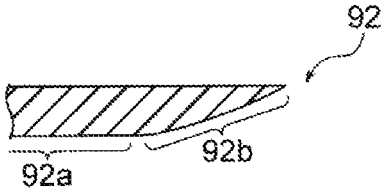

Heater support member 92 illustrated in FIG. 9B is a member installed to the fixation device in place of the heater support member in Embodiment 2, and has a curved-surface shape formed at both end portions in the width direction of the heater support member. Specifically, each of the support surfaces of heater support member 92 is formed from central portion support surface 92*a* and end portion support surface 92*b*. End portion support surface 92*b* includes a surface with a curved-surface shape, as illustrated in FIG. 9B. The curved-surface shape is not limited to the example illustrated in FIG. 9B.

Figure 9C:
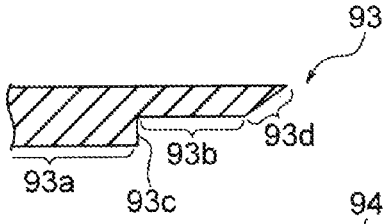

Heater support member 93 illustrated in FIG. 9C is a member installed to the fixation device in place of the heater support members in Embodiments 1 and 3, and has one step and one tapered portion at each end portion of the support surface in the width direction. Specifically, each of the support surfaces of heater support member 93 is formed from central portion support surface 93*a*, an end portion support surface, and step portion 93*c* between central portion support surface 93*a* and the end portion support surface described above. Meanwhile, end portion support surface described above is formed from first end portion support surface 93*b* on the step portion 93*c* side and tapered second end portion support surface 93*d*. Second end portion support surface 93*d* may have a curved-surface shape as in the case of end portion support surface 92*b* illustrated in FIG. 9B.

Figure 9D:
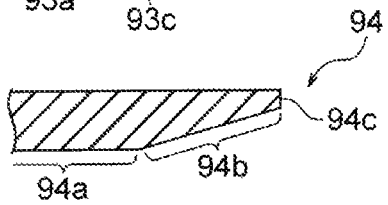

Heater support member 94 illustrated in FIG. 9D is a member installed to the fixation device in place of the heater support member in Embodiment 2, and has one tapered portion at each end portion of the support surface in the width direction. Specifically, each of the support surfaces of heater support member 94 is formed from central portion support surface 94*a*, tapered end portion support surface 94*b*, and step portion 94*c* which is an end surface of end portion support surface 94*b*. End portion support surface 94*b* may have a curved-surface shape as in the case of end portion support surface 92*b* illustrated in FIG. 9B.

Figure 9E:
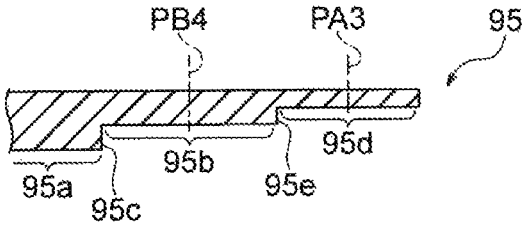

Heater support member 95 illustrated in FIG. 9E, is a member installed to the fixation device in place of the heater support members in Embodiments 1 and 3, and has two steps at each end portion of the support surface in the width direction. Specifically, each of the support surfaces of heater support member 95 is formed from central portion support surface 95*a*, an end portion support surface, and step portion 95*c* between central portion support surface 95*a* and the end portion support surface described above. Meanwhile, the end portion support surface described above is formed from first end portion support surface 95*b* on the step portion 95*c* side, second end portion support surface 95*d* on the opposite side, and step portion 95*e* between first end portion support surface 95*b* and second end portion support surface 95*d*.

Heater support member 95 illustrated in FIG. 9E is different from heater support member 91 illustrated in FIG. 9A in that, for example, the region corresponding to end portion PA3 in the width direction of the maximum fusible size (size A3 is illustrated) is positioned at second end portion support surface 95*d*, and the region corresponding to end portion PB4 in the width direction of a paper size one step smaller than the maximum size (size B4 is illustrated) is positioned at first end portion support surface 95*b*. As mentioned above, heater support member 95 is an example of Embodiment 1 including steps formed at multiple positions where the fixation belt is easily subjected to a concentrated stress attributed to printing medium P. Moreover, in the case where end portion PA3 indicates each of the end portions in the width direction of the drive roller, for example, it can also be said that heater support member 95 is an example where the steps are formed at the positions corresponding to the end portions in the width direction of the roller and the steps at the positions corresponding to the end portions in the width direction of the printing medium, which is described in Embodiment 3. What is more, the shapes of the support surfaces formed in stages as illustrated in FIG. 9E are not limited to the above. For example, the shape of the support surface illustrated in FIG. 9C may be employed.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device comprising:

an endless fixation belt which is runnably supported and includes an inner surface and an outer surface which comes into contact with a printing medium at a fixation position;

a contact member which includes a contact surface in contact with the inner surface of the fixation belt at the fixation position, the contact surface being displaceable in a region corresponding to a widthwise end portion of a printing medium passage area where the printing medium passes, the width direction being orthogonal to a conveyance direction of the printing medium; and a support member which includes a support surface supporting the contact member, wherein the support surface of the support member comprises a first support surface and a second support surface, the second support surface having a second distance from a reference passage surface of the printing medium to a position on the support surface corresponding to the widthwise end portion of the printing medium; and the first support surface having a first distance from the reference passage surface of the printing medium to a position on the support surface corresponding to a widthwise central portion of the printing medium, the second distance is larger than the first distance, and both of the first support surface and the second support surface are provided in the printing medium passage area.

2. The fixation device according to claim 1, wherein the support surface of the support member further comprises:

a step portion which connects the first support surface and the second support surface.

3. The fixation device according to claim 1, wherein the second support surface is inclined such that the second distance becomes larger toward a widthwise end portion of the support member.

4. The fixation device according to claim 1, further comprising:

a roller which is rotatably supported and is in contact with the outer surface of the fixation belt at the fixation position, wherein the region corresponding to the widthwise end portion of the printing medium passage area corresponds to a widthwise end portion of the roller.

5. The fixation device according to claim 4, wherein the reference passage surface of the printing medium is an outer surface of a widthwise central portion of the roller at the fixation position.

6. The fixation device according to claim 5, wherein the roller includes a large-diameter portion at each of both widthwise end portions of the roller, which has a larger diameter than the widthwise central portion of the roller.

7. The fixation device according to claim 1, wherein the contact member includes a heat generation member.

8. The fixation device according to claim 1, wherein the contact member includes a metal base material.

9. An image formation apparatus comprising:

an image formation unit which forms a developer image on the printing medium, and the fixation device according to claim 1 which fixes the developer image on the printing medium.

10. The fixation device according to claim 1, wherein the contact member comprises a heat generation member, and in both regions corresponding to the first support surface and the second support surface, the contact member faces the printing medium with the fixation belt between the contact member and the printing medium, and heats the printing medium.

11. The fixation device according to claim 1, wherein the second support surface of the support member is spaced away from the contact member, and the widthwise end portion of the printing medium passes in the region corresponding to the second support surface.

12. A fixation device comprising:

an endless fixation belt which is runnably supported and includes an inner surface and an outer surface which comes into contact with a printing medium at a fixation position;

a contact member which includes a contact surface in contact with the inner surface of the fixation belt at the fixation position, the contact surface being displaceable in regions corresponding to widthwise end portions of a printing medium passage area where the printing medium passes, the width direction being orthogonal to a conveyance direction of the printing medium; and a support member which includes a support surface supporting a first region of the contact member, the first region being inside, in the width direction, of widthwise end portions of the contact member, wherein the support member includes displacement restricting surfaces in second regions of the contact member, the second regions being outside, in the width direction, of the first region of the contact member, and the displacement restricting surfaces restrict a displacement of the contact member in a direction away from the inner surface of the fixation belt by a contact with the widthwise end portions of the contact member, wherein both of the first region of the contact member and the second regions of the contact member are provided in the printing medium passage area.

13. The fixation device according to claim 12, further comprising:

a roller which is rotatably supported and is in contact with the outer surface of the fixation belt at the fixation position, wherein the regions corresponding to the widthwise end portions of the printing medium passage area corresponds to widthwise end portions of the roller.

14. The fixation device according to claim 12, wherein the contact member includes a heat generation member.

15. The fixation device according to claim 12, wherein the contact member includes a metal base material.

16. An image formation apparatus comprising:

an image formation unit which attaches a developer image on the printing medium;

the fixation device according to claim 12 which fixes the developer image on the printing medium.

17. The fixation device according to claim 12, wherein the contact member comprises a heat generation member, and the first region and the second regions of the contact member face the printing medium with the fixation belt between the contact member and the printing medium, and heat the printing medium.

18. The fixation device according to claim 12, wherein the displacement restricting surfaces are spaced away from the contact member, and the widthwise end portions of the printing medium pass in the region corresponding to the displacement restricting surfaces.

* * * * *